US009138016B2

(12) United States Patent
Luan et al.

(10) Patent No.: US 9,138,016 B2
(45) Date of Patent: Sep. 22, 2015

(54) SMOKING ARTICLES WITH SIGNIFICANTLY REDUCED GAS VAPOR PHASE SMOKING CONSTITUENTS

(75) Inventors: Zhaohua Luan, Ledgewood, NJ (US); Mohammad R. Hajaligol, Glen Allen, VA (US); Randall E. Baren, Glen Allen, VA (US); Darin S. Colassaco, Midlothian, VA (US); Firooz Rasouli, Pully (CH)

(73) Assignee: PHILIP MORRIS USA INC., Richmond, VA (US)

( * ) Notice: Subject to any disclaimer, the term of this patent is extended or adjusted under 35 U.S.C. 154(b) by 1046 days.

(21) Appl. No.: 13/072,244

(22) Filed: Mar. 25, 2011

(65) Prior Publication Data

US 2012/0048286 A1 Mar. 1, 2012

Related U.S. Application Data

(60) Provisional application No. 61/318,245, filed on Mar. 26, 2010.

(51) Int. Cl.
*A24D 3/04* (2006.01)

(52) U.S. Cl.
CPC *A24D 3/045* (2013.01); *A24D 3/04* (2013.01); *A24D 3/043* (2013.01)

(58) Field of Classification Search
CPC ..... A21D 3/045; A24D 3/043
USPC ..... 131/344
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |

(Continued)

FOREIGN PATENT DOCUMENTS

| | | | |
|---|---|---|---|
| BE | 679657 | A | 10/1966 |
| BE | 1000454 | A4 | 12/1988 |

(Continued)

OTHER PUBLICATIONS

International Preliminary Report on Patentability mailed Oct. 2, 2012 for PCT/IB2011/001155.

*Primary Examiner* — Anthony Calandra
(74) *Attorney, Agent, or Firm* — Buchanan, Ingersoll & Rooney PC

(57) ABSTRACT

A smoking article having a tobacco rod, which is adapted to produce mainstream smoke, and a filter attached to said tobacco rod. A permeable wrapping paper circumscribes the tobacco rod and the filter. The filter has an upstream end portion and a downstream end portion, and includes a flow restricting segment of smoke impermeable material, which includes at least one open flow passage therethrough to deliver mainstream smoke, and a cavity downstream of the flow restricting segment. The smoking article also includes at least one ventilation zone upstream of the flow restricting segment.

20 Claims, 18 Drawing Sheets

(56) References Cited

U.S. PATENT DOCUMENTS 2,954,786 A 10/1960 Lebert
3,098,492 A 7/1963 Wurzburg et al.
3,234,949 A 2/1966 White et al.
3,236,244 A 2/1966 Irby, Jr. et al.
3,255,760 A 6/1966 Selke
3,260,266 A 7/1966 Miller
3,283,762 A 11/1966 Kissel
3,292,635 A 12/1966 Kolodny
3,318,312 A 5/1967 Curtis, Jr.
3,323,525 A 6/1967 Miller
3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A 2/1970 Tomkin
3,504,677 A 4/1970 Doppelt
3,581,748 A 6/1971 Cameron
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,034,765 A * 7/1977 Hall ..... 131/336
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,209,026 A 6/1980 Dock
4,256,122 A 3/1981 Johnson
4,256,126 A 3/1981 Seligman et al.
4,273,141 A 6/1981 Jan Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A 10/1986 Keith
4,620,553 A 11/1986 Bale et al.
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh et al.
4,809,717 A 3/1989 Imbery et al.
4,867,182 A 9/1989 Roberts et al.
4,893,638 A * 1/1990 Lauterbach ..... 131/364
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,549,125 A 8/1996 White
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
7,878,963 B2 2/2011 Li et al.
8,109,277 B2 2/2012 Li et al.
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1 12/2004 Dube et al.
2005/0066981 A1 3/2005 Crooks et al.
2006/0011206 A1 1/2006 Clarke
2006/0201524 A1 9/2006 Zhang et al.
2007/0169785 A1 7/2007 Gedevanishvili et al.

(56) References Cited

U.S. PATENT DOCUMENTS

| | | | |
|---|---|---|---|
| 2007/0181140 | A1 | 8/2007 | Xue et al. |
| 2007/0186945 | A1 | 8/2007 | Olegario et al. |
| 2007/0261706 | A1 | 11/2007 | Banerjea et al. |
| 2008/0017204 | A1 | 1/2008 | Braunshteyn et al. |
| 2008/0035162 | A1 | 2/2008 | Braunshteyn et al. |
| 2008/0047571 | A1 | 2/2008 | Braunshteyn et al. |
| 2008/0163877 | A1 | 7/2008 | Zhuang et al. |
| 2008/0216850 | A1 | 9/2008 | Li et al. |
| 2008/0216851 | A1 | 9/2008 | Olegario et al. |
| 2008/0216853 | A1 | 9/2008 | Li et al. |
| 2010/0288293 | A1 | 11/2010 | Slasli et al. |
| 2011/0083675 | A1 | 4/2011 | Olegario et al. |

FOREIGN PATENT DOCUMENTS

| | | | |
|---|---|---|---|
| DE | 3439861 | A1 | 5/1985 |
| EP | 0 054 705 | A1 | 6/1982 |
| EP | 0077123 | A2 | 4/1983 |
| EP | 0101840 | A | 3/1984 |
| EP | 0212879 | A1 | 3/1987 |
| EP | 0 327 655 | A1 | 8/1989 |
| EP | 0364256 | A1 | 4/1990 |
| EP | 0471581 | A1 | 2/1992 |
| EP | 0482872 | A1 | 4/1992 |
| EP | 0568107 | A | 11/1993 |
| EP | 0481596 | B1 | 1/1994 |
| FR | 2481581 | | 11/1981 |
| FR | 2873899 | A | 2/2006 |
| GB | 1058342 | A | 2/1967 |
| GB | 1228747 | | 4/1971 |
| GB | 1236344 | A | 6/1971 |
| GB | 1245518 | A | 9/1971 |
| GB | 1256154 | | 12/1971 |
| GB | 1428018 | | 3/1976 |
| GB | 2100573 | A | 1/1983 |
| GB | 2149287 | A | 6/1985 |
| GB | 2177890 | A | 2/1987 |
| NZ | 196978 | | 11/1983 |
| NZ | 216244 | | 9/1989 |
| WO | WO 90/09741 | A | 9/1990 |
| WO | WO 99/26495 | A | 6/1999 |
| WO | WO 00/00047 | | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO 2007/093757 | A1 | 8/2007 |
| WO | WO 2007/110650 | A1 | 10/2007 |

* cited by examiner

FIG. 6

Smoke Chemistry

| Cigarette Sample | Smoking characteristics | | | | | Smoke chemistry | | | | | |
|---|---|---|---|---|---|---|---|---|---|---|---|
| | RTD (mm) | Vent (%) | TPM (mg) | Duration (pc) | | AA (ug) | HCN (ug) | $CH_4$ ($x10^3$) | NO (ug) | CO (mg) | $CO_2$ (mg) |
| IM17- control | 106 | 0 | 20.6 | 7.8 | 7.2 | 891 | 190 | 588 | 356 | 19.3 | 43.2 |
| 2R4F- control | 131 | 32 | 11.7 | 9.4 | 8.9 | 655 | 118 | 578 | 266 | 14.5 | 38.7 |
| FF | 105 | 14 | 18.2 | 8.4 | 7.9 | 643 | 147 | 558 | 241 | 15.4 | 37.5 |
| L | 121 | 28 | 14.3 | 9.1 | 8.4 | 701 | 144 | 557 | 305 | 15.1 | 38.6 |
| UL | 105 | 46 | 8.6 | 8.5 | 8.1 | 460 | 78 | 382 | 207 | 10.1 | 27.1 |
| NTR016-001 | 89 | 50 | 15.3 | 8.0 | 7.8 | 383 | 83 | 363 | 137 | 8.0 | 22.5 |
| NTR016-002 | 89 | 54 | 12.4 | 8.0 | 7.9 | 334 | 72 | 312 | 107 | 6.5 | 19.6 |
| NTR016-003 | 71 | 57 | 10.4 | 8.0 | 7.9 | 286 | 52 | 246 | 84 | 4.6 | 16.2 |
| NTR016-004 | 84 | 75 | 8.3 | 8.0 | 7.9 | 247 | 43 | 228 | 74 | 4.2 | 15.2 |
| NTR016-005 | 80 | 83 | 5.5 | 8.0 | 7.9 | 213 | 30 | 155 | 56 | 3.0 | 11.9 |
| NTR016-006 | 77 | 87 | 4.4 | 8.0 | 7.9 | 189 | 25 | 132 | 43 | 2.3 | 10.0 |

Note: (1) Designation: pc — puff count; AA — acetaldehyde; Vent — % air dilution
(2) Mean values from 5 prototype cigarettes of each set, or all control cigarettes tested

FIG. 7

Smoke Chemistry

| Cigarette Sample | Smoking characteristics | | | | | Smoke chemistry per TPM (/mg) | | | | | |
|---|---|---|---|---|---|---|---|---|---|---|---|
| | RTD (mm) | Vent (%) | TPM (mg) | Duration (pc) | | AA (ug) | HCN (ug) | $CH_4$ ($x10^3$) | NO (ug) | CO (mg) | $CO_2$ (mg) |
| IM17- control | 106 | 0 | 20.6 | 7.8 | 7.2 | 43 | 9.2 | 28.5 | 17.3 | 0.94 | 2.1 |
| 2R4F- control | 131 | 32 | 11.7 | 9.4 | 8.9 | 55 | 10.1 | 49.4 | 22.7 | 1.24 | 3.3 |
| FF | 105 | 14 | 18.2 | 8.4 | 7.9 | 35 | 8.1 | 30.7 | 13.2 | 0.85 | 2.1 |
| L | 121 | 28 | 14.3 | 9.1 | 8.4 | 49 | 10.1 | 39.0 | 21.3 | 1.06 | 2.7 |
| UL | 105 | 46 | 8.6 | 8.5 | 8.1 | 53 | 9.1 | 44.4 | 24.1 | 1.17 | 3.2 |
| NTR016-001 | 89 | 50 | 15.3 | 8.0 | 7.8 | 25 | 5.4 | 23.7 | 8.9 | 0.52 | 1.5 |
| NTR016-002 | 89 | 54 | 12.4 | 8.0 | 7.9 | 26 | 5.8 | 25.2 | 8.6 | 0.52 | 1.6 |
| NTR016-003 | 71 | 57 | 10.4 | 8.0 | 7.9 | 27 | 5.0 | 23.7 | 8.1 | 0.44 | 1.6 |
| NTR016-004 | 84 | 75 | 8.3 | 8.0 | 7.9 | 29 | 5.2 | 27.5 | 8.9 | 0.51 | 1.8 |
| NTR016-005 | 80 | 83 | 5.5 | 8.0 | 7.9 | 38 | 5.5 | 28.2 | 10.2 | 0.55 | 2.2 |
| NTR016-006 | 77 | 87 | 4.4 | 8.0 | 7.9 | 42 | 5.7 | 30.0 | 9.8 | 0.52 | 2.3 |

Note: (1) Designation: pc — puff count; AA — acetaldehyde; Vent — % air dilution
(2) Mean values from 5 prototype cigarettes of each set, or all control cigarettes tested

| Combustion zone | Distribution zone | Delivery zone |
|---|---|---|
| ☐ Tobacco rod: #9474<br>☐ Length: 30 mm<br>☐ Weight: 466 mg | ☐ Media: High permeable CA hollow tube<br>☐ Dimension: 30(L) x 8 (o.d.) x 6 (i.d.) mm<br>☐ Wrapping paper: 100 coresta unit<br>☐ Perforation line (8 x 0.5 mm i.d.): None | ☐ 1st W-T filter: 5 mm<br>☐ Orifice: 1 mm i.d.<br>☐ Buffer: 5 mm<br>☐ 2nd W-T filter: 9 mm |

DESIGN SPECIFICATION:

| Combustion zone | Distribution zone | Delivery zone |
|---|---|---|
| ☐ Tobacco rod: #9474<br>☐ Length: 30 mm<br>☐ Weight: 466 mg | ☐ Media: High permeable CA hollow tube<br>☐ Dimension: 30(L) x 8 (o.d.) x 6 (i.d.) mm<br>☐ Wrapping paper: 150 coresta unit<br>☐ Perforation line (8 x 0.5 mm i.d.): None | ☐ 1st W-T filter: 5 mm<br>☐ Orifice: 1 mm i.d.<br>☐ Buffer: 5 mm<br>☐ 2nd W-T filter: 9 mm |

| Combustion zone | Distribution zone | Delivery zone |
|---|---|---|
| ☐ Tobacco rod: #9474 | ☐ Media: High permeable CA hollow tube | ☐ 1st W-T filter: 5 mm |
| ☐ Length: 30 mm | ☐ Dimension: 30(L) x 8 (o.d.) x 6 (i.d.) mm | ☐ Orifice: 1 mm i.d. |
| ☐ Weight: 466 mg | ☐ Wrapping paper: 200 coresta unit | ☐ Buffer: 5 mm |
| | ☐ Perforation line (8 x 0.5 mm i.d.): 1 row | ☐ 2nd W-T filter: 9 mm |

| Combustion zone | Distribution zone | Delivery zone |
|---|---|---|
| ☐ Tobacco rod: #9474<br>☐ Length: 30 mm<br>☐ Weight: 466 mg | ☐ Media: High permeable CA hollow tube<br>☐ Dimension: 30(L) x 8 (o.d.) x 6 (i.d.) mm<br>☐ Wrapping paper: 200 coresta unit<br>☐ Perforation line (8 x 0.5 mm i.d.): 2 row | ☐ 1st W-T filter: 5 mm<br>☐ Orifice: 1 mm i.d.<br>☐ Buffer: 5 mm<br>☐ 2nd W-T filter: 9 mm |

DESIGN SPECIFICATION:

| Combustion zone | Distribution zone | Delivery zone |
|---|---|---|
| ☐ Tobacco rod: #9474<br>☐ Length: 30 mm<br>☐ Weight: 466 mg | ☐ Media: High permeable CA hollow tube<br>☐ Dimension: 30(L) x 8 (o.d.) x 6 (i.d.) mm<br>☐ Wrapping paper: 200 coresta unit<br>☐ Perforation line (8 x 0.5 mm i.d.): 3 row | ☐ 1st W-T filter: 5 mm<br>☐ Orifice: 1 mm i.d.<br>☐ Buffer: 5 mm<br>☐ 2nd W-T filter: 9 mm |

SMOKING ARTICLES WITH SIGNIFICANTLY REDUCED GAS VAPOR PHASE SMOKING CONSTITUENTS

CROSS REFERENCE TO RELATED APPLICATION

This application claims priority under 35 U.S.C. §119(e) to U.S. Provisional Application No. 61/318,245, filed on Mar. 26, 2010, the entire content of which is incorporated herein by reference thereto.

BACKGROUND

Heretofore, cigarettes with high levels of ventilation have usually had unacceptably low levels of resistance to draw (RTD) unless some counter measure was in place to make-up the shortfall in RTD. In the past, high density cellulose acetate filter segments were used to address the shortfall. However such filtered segments tended to reduce tar delivery (FTC), with little or no effect upon gas phase constituents of mainstream tobacco smoke, such as carbon monoxide (CO) and nitrogen oxide (NO). This solution tended to worsen the CO to tar (FTC) ratios in lower delivery (FTC tar) cigarettes.

Ventilation has a desirable attribute in that, when operating alone, it will reduce both the particulate phase and the gas phase of mainstream smoke. Highly ventilated cigarettes however have drawbacks in RTD as previously discussed.

SUMMARY

Provided is a smoking article including a flow restriction device, a cavity and an upstream ventilation zone. Preferably, the ventilation zone is in communication with the cavity. In an embodiment, the smoking article can also include additional ventilation zones upstream and/or downstream of the flow restriction device.

In accordance with an embodiment, a smoking article comprises: a tobacco rod, which is adapted to produce mainstream smoke; a filter attached to said tobacco rod, the filter having an upstream end portion and a downstream end portion, the filter comprising: a flow restricting segment of smoke impermeable material, which includes at least one open flow passage therethrough to deliver mainstream smoke; and a cavity downstream of the flow restricting segment; a permeable wrapping paper, which circumscribes the tobacco rod and the filter; and at least one ventilation zone upstream of the flow restricting segment.

In accordance with a further embodiment, a smoking article comprises: a densely packed tobacco rod adapted to produce mainstream smoke; and a filter having an upstream end portion and a downstream end portion, said filter arranged to receive mainstream smoke at said upstream end portion, said filter comprising: a diffusion zone, which allows significant air inflow to dilute and transfer the smoke directly to the downstream portion of filter, the diffusion zone having a highly permeable cellulose acetate hollow tube and a high permeable wrapping paper; and a delivery zone, the delivery zone comprising a flow restriction element with a downstream cavity as a flow buffer for desirable draw resistance, wherein the flow restriction element includes a restriction establishing a substantial portion of a predetermined resistance to draw of said smoking article.

Described herein is a highly ventilated smoking article with desired amounts of resistance to draw and having provisions for facilitating high speed cigarette manufacturing on conventional cigarette making equipment.

DESCRIPTION OF THE DRAWINGS

FIG. 6 is a chart showing the smoke chemistry for commercially available cigarettes and a series of smoking articles as shown in FIG. 5.

FIG. 7 is a chart showing the smoke chemistry per total particulate matter (TPM) for commercially available cigarettes and a series of smoking articles as shown in FIG. 5.

DETAILED DESCRIPTION OF THE PREFERRED EMBODIMENTS

Figure 1:
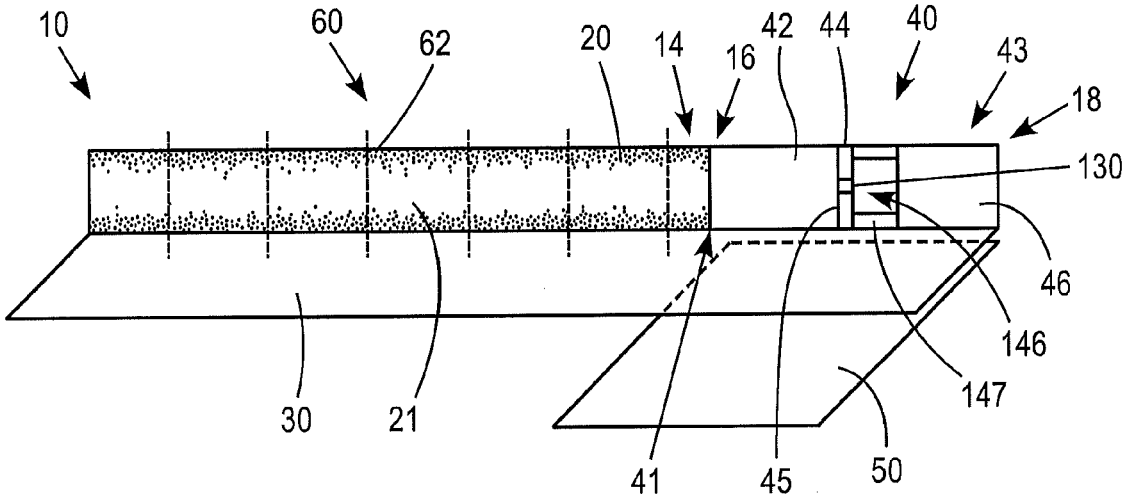
FIG. 1 is a side view of a smoking article in accordance with one embodiment, the smoking article including a flow restriction device and multiple ventilation zones upstream of the flow restriction device.

Since the 1960's there has been significant efforts to develop mechanical type filters, such as jet or impaction filters, which are constructed with at least one flow restriction filter element and substantial downstream air dilution, in an effort to reduce tar levels in mainstream smoke. The flow restriction filter element can be an impaction plate, a short polymer column with a number of holes along the axis, or simply a high density cellulose acetate plug with holes therein. Such mechanical filters rely heavily on the high flowrate through the holes, which correlates strongly to high pressure drops before and after the flow restriction element.

However, there are drawbacks in current designs due to inconsistency and less redundancy of pressure drop and percentage air dilution, as the functioning of the filter unit is critically dependent on hole dimensions, wall thicknesses, number of holes, downstream air dilution, and total particulate matter (TPM) build-up during smoking.

Described herein is a smoking article provides the benefit of a highly ventilated smoking article with desired amounts of resistance to draw, in which air dilution is positioned upstream (frontal) to a flow restriction element for improved consistency and redundancy of various smoking characteristics, such as percentage air dilution and total pressure drop. In general, the smoking article combines a mainstream smoke produced by a tobacco rod with a desirable level of air dilution in the cigarette rod or column which includes a highly permeable wrapping paper, which is optionally perforated, or in a perforated mixing chamber before access into a flow restriction filter element. The total combined volume through the flow restriction filter element is preferably significantly higher (i.e., in accordance with an embodiment, about a 3 fold increase for a typical ultra light smoke delivery without filtration, which combines about 25 percent mainstream smoke with about 75 percent air dilution), which results in an increased flow-rate and, therefore, an improved efficiency of the flow restriction filters.

In accordance with another embodiment, the increased total volume also provides for a flow restriction element to have larger holes for improved redundancy of pressure drop and machinability, since during the course of smoking, the total pressure drop is largely controlled by the size of the hole and/or length of the flow restriction column, independent of upstream air dilution.

In a preferred embodiment, the smoking article includes a flow restriction element and at least one ventilation zone upstream of the flow restriction element so as to provide about 20% to about 80% air to mainstream smoke. In an embodiment, the smoking article also includes at least one ventilation zone downstream of the flow restriction element.

In accordance with another embodiment, a smoking article is described herein that includes a combustion zone comprised of a short but densely packed tobacco rod, a diffusion zone which allows significant airflow, and a delivery zone comprised of at least one flow restriction element with a downstream cavity.

Referring now to FIG. 1, a preferred embodiment provides a smoking article 10 including a filter 40 adjacent to a tipped end 14 (i.e., downstream end) of a generally cylindrical rod 20 of smoking material 21, contained in a circumscribing permeable outer wrapper or wrapping paper 30. The filter 40 includes a flow restricting segment 44 of smoke impermeable material, which includes at least one open flow passage 130 therethrough to deliver mainstream smoke, and a cavity 146 downstream of the flow restricting segment 44. The smoking article 10 also preferably includes at least one ventilation zone upstream of the flow restricting segment. In accordance with an embodiment, the at least one open flow passage 130 has a single hole having a diameter of about 0.6 mm.

Typically, the generally cylindrical rod 20 of smoking material 21 is referred to as a "tobacco rod" and has a lit end 12 and a tipped end 14. The smoking material 21 (or tobacco filler) normally is employed so as to fill the tobacco rod at a packing density of about 100 mg/cm$^3$ to about 300 mg/cm$^3$, and often about 150 mg/cm$^3$ to about 275 mg/cm$^3$. The smoking material 21 is wrapped with a low permeability paper to form the cylindrical rod 20. Tobaccos can have a processed form, such as processed tobacco stems (e.g., cut-rolled or cut-puffed stems), volume expanded tobacco (e.g., puffed tobacco, such as propane expanded tobacco and dry ice expanded tobacco), or reconstituted tobacco (e.g., reconstituted tobaccos manufactured using paper-making type or cast sheet type processes). Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. It can be appreciated that the precise amount of each type of tobacco within a tobacco blend used varies from smoking article to smoking article. If desired, in addition to the aforementioned tobacco materials, the tobacco blend can further include other flavor components, including menthol.

The tobacco rod 20 is arranged such that the filter 40 and tobacco rod 20 are axially aligned in an end-to-end relationship, preferably abutting one another. The filter 40 has a generally cylindrical shape, and the diameter thereof is essentially equal to the diameter of the tobacco rod 20. Preferably, the upstream end 16 and the buccal or downstream end 18 of the filter 40 are open to permit the passage of air and smoke therethrough.

The outer wrapper or wrapping paper 30 is preferably a highly permeably or porous wrapping material having permeability of at least 50 Coresta units (1 Coresta unit (Cu)=1 cm/kPa), and more preferably at least 100 Coresta units, and more preferably between about 100 Coresta units and about 200 Coresta units.

In an embodiment, the filter 40 includes an upstream filter segment 42 and a downstream filter segment 46 comprised of filtering material and a flow restricting segment 44 circumscribed by the wrapping material 30. Preferably, the upstream filter segment 42 and the downstream filter segment 46 of filtering material are low particulate efficiency filter segments preferably constructed from less densely packed, large diameter fiber cellulose acetate tow of about 5.0 denier to about 15.0 denier per filament (dpf), such as 8 dpf, and about 10,000 to about 50,000 total denier (td), such as 35,000 td.

In accordance with an embodiment, the flow restricting segment 44 includes one or more flow restriction passages or holes 130 therethrough. The flow restricting segment 44 can include at least one flow restriction element 45 adjacent the first upstream filter plug 46 of a length of about 3 mm to about 10 mm, more preferably about 3 mm to about 7 mm in length.

Preferably, a cavity 146 within the filter 40 is defined at least in part by a tubular filter segment 147, such as a cylindrical cellulosic tube and by the spaced apart relation of the downstream filter plug and the flow restrictor disc 45.

The filter 40 attaches to the tobacco rod 20 by a tipping material 50, which preferably circumscribes the filter 40 and an adjacent portion of the tobacco rod 20. The tipping material 50 is typically a paper like product; however, any suitable material can be used. In accordance with an embodiment, the inner surface of the tipping material 50 is fixedly secured to the outer surface of the wrapping material 30, using a suitable adhesive.

Upon lighting of the smoking article 10, the mainstream smoke is generated by and drawn from the tobacco rod 20 and through the filter 40. As used herein, the terms "upstream" and "downstream" describe relative positions between the filter 40 and other features in relation to the direction of mainstream smoke as it is drawn from the tobacco rod 20 and through the filter 40.

In accordance with a preferred embodiment, the upstream and downstream (i.e., mouth end or buccal end) plugs 42, 46 of filtering material are a starch-based, polypropylene, or plasticized cellulose acetate tow, filter paper or other suitable material. The upstream and the downstream plugs 42, 46 of filtering material can alternatively have the form of a gathered web (e.g., polypropylene web, polyester web, cellulosic web or starch-based web). However, the filtering material can be carbon-on-tow (a cellulose acetate element mixed with an activated carbon material throughout), activated carbon, gas-vapor phase sorbents or any other suitable filtering material. In accordance with an embodiment, the upstream and the downstream plugs 42, 46 of filtering material each have a generally cylindrical shape, and an outer diameter thereof that is essentially equal to the outer diameter of the tobacco rod 20.

The filter 40 typically has an overall length of about 15 mm to about 40 mm in length for a smoking article 10 having an overall length of about 80 to about 160 mm. Each filter segment 42, 46 of filtering material can have an equal length, or the upstream and downstream plugs 42, 46 can have different lengths. It can also be appreciated that the length of the upstream and downstream plugs 42, 46 of filtering material can vary depending on additional materials within the filtering material including activated carbons or other gas-vapor phase sorbent or additive materials.

The flow restriction element 45 establishes the flow restriction and is preferably sized to contribute sufficient pressure drop such that the smoking article 10 presents a resistance to draw of at least about 70 mm water or greater, and more preferably in the range of about 80 mm water to about 120 mm water. The flow restriction element 45 preferably has one or optionally, at least one or more flow restriction passages or holes 130 of a diameter of about 0.5 mm to about 0.9 mm and more preferably about 0.5 mm to 0.7 mm. Since the pressure drop of the flow restricting segment 44 depends on the open area, one or more flow restriction passages or holes 130 can also be used. In accordance with an embodiment, the flow restriction element 45 has a diameter of about 7.0 mm to about 8.0 mm, and more preferably a diameter of about 7.4 mm to about 7.8 mm.

In accordance with an embodiment, the flow restricting segment 44 may be constructed of paper, a plastic or a metal and more preferably made of a paper product or a biodegradable plastic or other suitable material having degradability properties.

The smoking article 10 also preferably includes at least one ventilation zone 60, which provides air dilution to the smoking article 10. In accordance with an embodiment, the wrapping material 30 is perforated with a first row (and optionally second and possibly a third row) or series of ventilation holes or perforations 62, which extend through the wrapping material 30 to form a ventilation zone 60. Alternatively, the outer wrapper or wrapping paper 30 can be a porous wrapping material or paper material having a permeability of less than 100 Coresta units with a row or series of ventilation holes or perforations 62. Preferably, the holes or perforations 62 of the ventilation zone 60 achieve a ventilation level of the smoking article 10 of at least about 20% and more preferably at least about 50% to about 90% by volume.

In a preferred embodiment, the ventilation zone 60 is located upstream of the flow restricting segment 44. The ventilation zone 60 can be located along the tobacco rod 20 and/or along the filter 40. The holes and/or perforations 62 can be formed using online laser perforation techniques, off-line, pre-perforated tipping paper, mechanical perforation, electrostatic perforation and other techniques. By locating the ventilation zone 60 upstream of the flow restricting segment 44, percent air dilution and total pressure drop can be controlled. Also, since the ventilation zone 60 is upstream, the total smoke volume going through the flow restriction filter is increased so as to increase the flow-rate and improve the efficiency of the filter. During the course of smoking, the total pressure drop is largely controlled by the size of the hole in the flow restriction filter element and/or the length of the flow restriction filter element, independent of the upstream air dilution.

The filter 40 can also include a plurality of ventilation holes or perforations 60 on either the downstream and/or upstream side of the flow restricting segment 44 in addition to the upstream ventilation zone described above. In use, the filter 40 incorporating the at least one flow restriction element 45 into the cigarette or smoking article 10, minimizes the ratio of total particulate matter (TPM) and tar yield by increasing the filtration efficiency for particulates (tar) with the increase of flow rate or puff volume. Specifically, the range of TPM or tar that the smoker is exposed to, by increasing puff volume, is reduced due to the reduction in smoking elasticity, i.e. reduction in Tar $(mg/cigt)_{MDPH}$/Tar $(mg/cigt)_{FTC}$.

Figure 2:
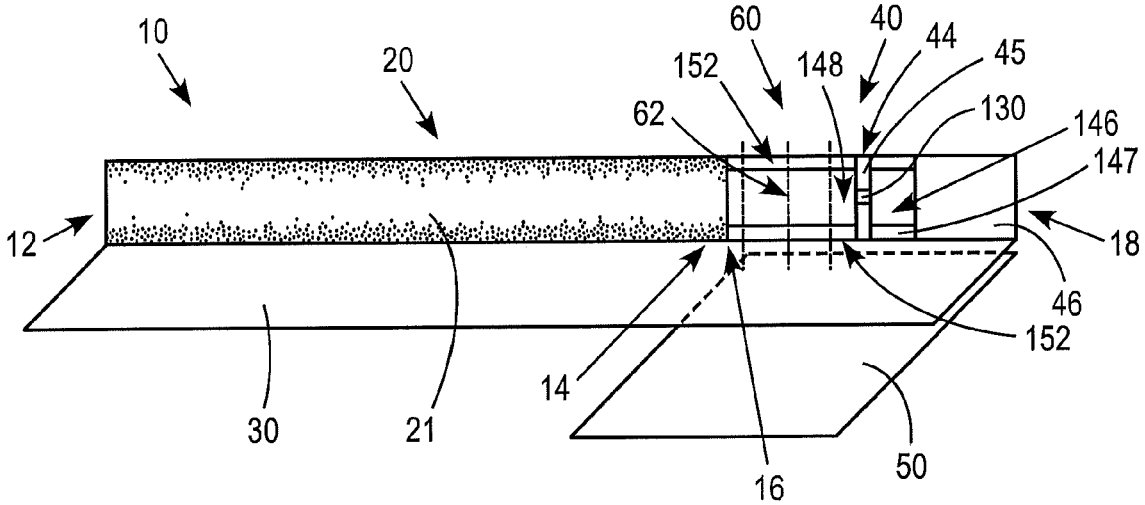
FIG. 2 is a side view of a smoking article in accordance with a further embodiment, including a flow restriction device, a cavity, and at least one ventilation zone upstream of the flow restriction device and in communication with the cavity.

Referring now to FIG. 2, in accordance with another embodiment provides a smoking article 10 comprising a tobacco rod 20 and filter 40 wrapped in a highly permeable wrapping material 30. As shown in FIG. 2, the filter 40 includes an upstream cavity 148, a flow restricting segment 44, and a downstream cavity 146, which is defined at least in part by a tubular filter segment 147, and a downstream segment 42 of filtering material. The flow restricting segment 44 is preferably comprised of a flow restriction element 45 having one or more flow restricting passages or openings 130 therein.

In an embodiment, the upstream cavity within the filter 40 is defined at least in part by the tubular segment 152 and optionally, in part by the space enclosed by the tubular section of the flow restriction element 45. Preferably, the upstream cavity 148 includes a ventilation zone 60 comprised of at least one row, and more preferably 2 to 4 rows of ventilation holes and/or perforations 62. The tubular segment 152 is preferably constructed from a hollow acetate tube (HAT) and is preferably air permeable (low density) so that ventilation air may be drawn through ventilation holes 62 into the upstream cavity 148 during a puff. Other low density, low filtration materials can also be used to construct the tubular segment 152.

In a preferred embodiment, the ventilation zone 60 comprises a plurality of ventilation holes 62 arranged in one or more circumferential rows, which extend through the tipping paper 50 and the highly permeable wrapping paper 30, and optionally/partially into or through the tubular segment 152. This arrangement facilitates the use of off-line laser perforation techniques to provide ventilation holes 62. Other techniques may be used to create the ventilation zone 60 such as using on-line, laser perforation, mechanical pin perforation techniques, electrostatic perforation and other techniques. In accordance with an embodiment, the ventilation holes 62 in the tipping paper 50 allow atmospheric air to be drawn into the restricting ventilation zone 40, through the tubular segment 152, and into the upstream cavity 148. When a hollow acetate tube forms at least part of the tubular segment 152, in accordance with another embodiment, perforations need not be made in the upstream cavity 148 because the material is air permeable.

In accordance with an embodiment, it may be desirable to provide several ventilating zones 60 at locations in superposing relation to the one or more flow restriction passages or holes 130 provided in the flow restricting filter segment 44 so as to achieve the more elevated ventilation levels. Preferably, the ventilation zone 60 and the one or more flow restriction passages or holes 130 in the flow restricting filter segment 44 achieve a ventilation level of the smoking article of at least 25% and more preferably at least 50% to 90%.

Figure 3:
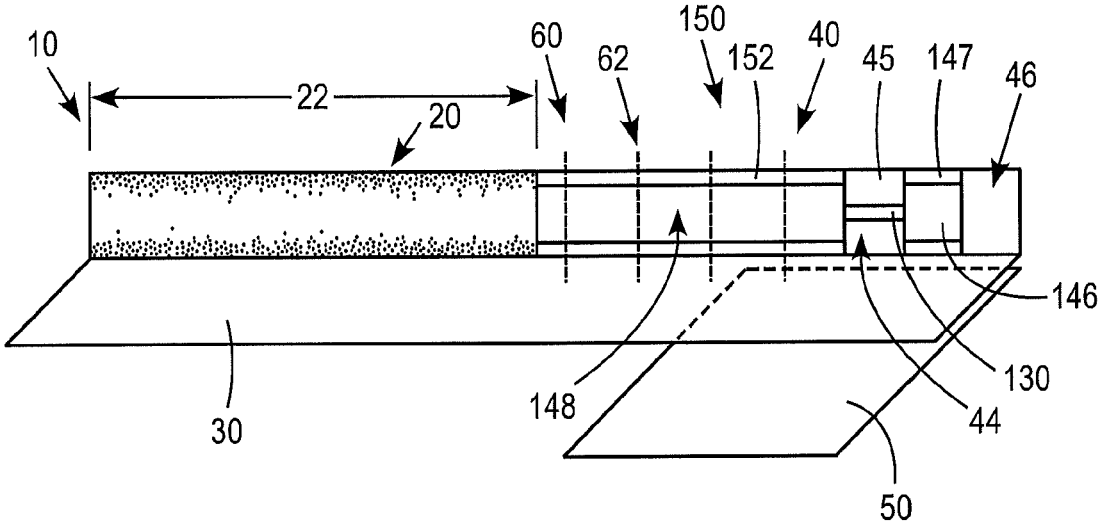
FIG. 3 is a side view of a smoking article in accordance with another embodiment, including a flow restriction device, a cavity, and at least one ventilation zone upstream of the flow restriction device and in communication with the cavity.

Referring to FIG. 3, in accordance with a further embodiment, the smoking article 10 is comprised of a densely packed tobacco rod 20 and a filter 40, which are wrapped in highly permeable wrapping paper 30. The filter 40 preferably includes a diffusion zone or segment 150 comprised of an upstream cavity 148 comprised of a hollow tubular segment 152, a flow restricting segment 44, a downstream cavity 146, and a downstream segment 46 of filtering material.

In accordance with one embodiment, the tobacco rod 20 has a packing density of 10% to 200% higher than a regular tobacco rod. The length 22 of the tobacco rod 20 is preferably 2/10 to 8/10 of the length of a regular tobacco rod. In accordance with an embodiment, the densely packed tobacco rod 20 provides for a slower burning tobacco rod 20 as compared to a regular or commercially available tobacco rod. In accordance with an embodiment, the tobacco rod 20 has a length of about 25 to 35 mm and more preferably about 30 mm for a smoking article 10 having an overall length of about 80 to 90 mm and more preferably about 84 mm.

The diffusion zone or segment 150 is preferably comprised of a media which allows significant air inflow to dilute and transfer the smoke directly to the downstream portion of filter 40. In accordance with an embodiment, the diffusion zone 150 includes a highly permeable cellulose acetate hollow tubular segment 152, which is surrounded by a highly permeable wrapping material 30 with varying permeability, and which may optionally include additional ventilation 60 in the form of at least one row of perforations 62.

The filter 40 also includes a flow restricting segment 44, which includes at least one flow restriction element 45 with a downstream cavity 146 as a flow buffer for a desirable draw resistance (i.e., pressure drop) without significant filtration effect to the tar in the mainstream smoke. In an alternative embodiment, low efficiency filters, such as whistle-through cellulose acetate filter or a recess filter, can be placed adjacent to the flow restriction element 45 to achieve optimized flow control.

In accordance with an embodiment, the filter 40 includes a flow restriction element 45 in the form of an annular disk 132 that defines at least one or more flow restriction passages or holes 130 (or flow restriction) of reduced diameter. In accordance with an embodiment, the hole 130 preferably has a diameter of about 0.5 mm to about 2.5 mm and more preferably about 0.5 mm to 2.0 mm, and a length of about 0.5 mm to 20 mm, and more preferably about 5 mm to 15 mm.

The downstream cavity 146 is preferably formed with a downstream tubular body portion 147 that spaces the flow restriction element 45 a predetermined distance apart from the downstream segment 46 of filtering material, preferably about 1 mm to about 6 mm, and more preferably about 1 mm to 3 mm. Preferably, the distance between the ventilation zone 60 and the downstream segment 46 of filtering material is at least 5 mm, and more preferably in the range of about 5 mm to about 12 mm.

For example, the flow restriction element 45 can be formed of a polymer column including a single, centered hole 130 having a diameter of about 1.0 mm. A highly permeable cellulose acetate hollow tubular segment 152 can be positioned adjacent to and upstream of the flow restriction element 45 to provide sufficient air inflow. The total pressure drop is largely controlled by the length of the polymer column and the diameter of the single, centered hole.

Figure 4:
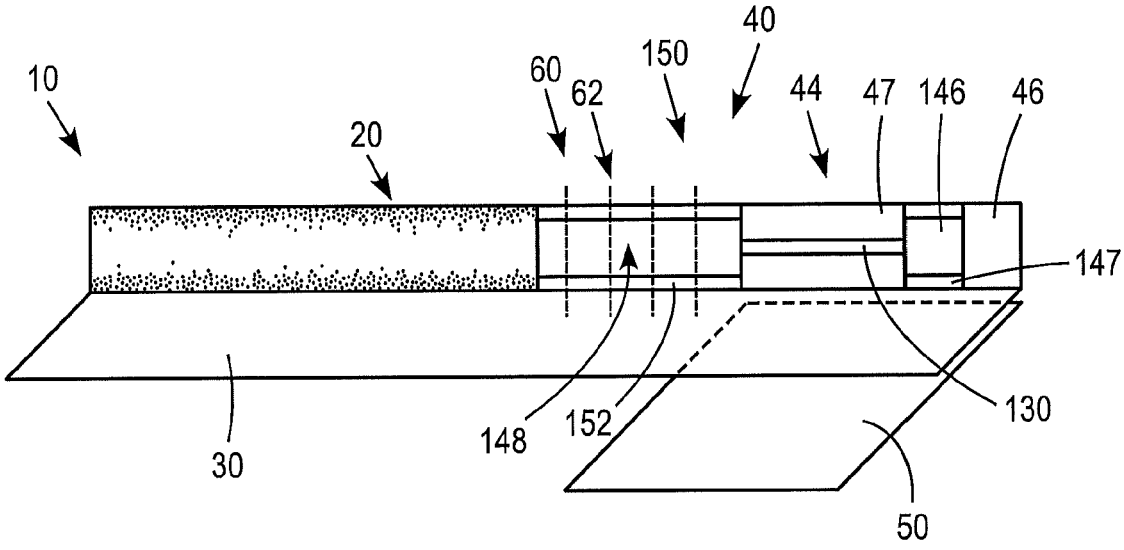
FIG. 4 is a side view of a smoking article in accordance with a further embodiment, including a flow restriction device, a cavity, and at least one ventilation zone upstream of the flow restriction device and in communication with the cavity.

Referring to FIG. 4, in accordance with a further embodiment, the flow restriction element 45 is a polymer column 47 with a centered bypass passage or hole 130 preferably having a diameter of about 0.5 mm to about 2.0 mm and a length of about 1.0 mm to about 20.0 mm and more preferably about 5.0 mm to about 10.0 mm, or a high density/low permeability cellulose acetate column with a central bypass passage or hole 130 preferably having a diameter of about 0.5 mm to about 2.0 mm and a length of about 1.0 mm to about 20.0 mm and more preferably about 5.0 mm to about 10.0 mm.

It is to be appreciated that in all embodiments, the filter may be constructed from simple combining techniques typically used in the industry for manufacturing cigarettes at high speeds. Additionally each embodiment includes support about the cavity 146 so as to provide desired firmness throughout length of the filter 40.

In accordance with an embodiment, the diffusion zone 150 includes a highly permeable cellulose acetate hollow tubular segment 152, which is surrounded by a highly permeable wrapping material 30 with varying permeability, and which may optionally include additional ventilation 60 in the form of at least one row, and more preferably at least two or three rows of ventilation holes or perforations 62.

In accordance with an embodiment, the ventilation 60 in combination with tobacco rod 20 and filter 40 with a highly permeable wrapping paper 30 provides the necessary amount of resistance to draw while maintaining the desired degree of high ventilation throughout the smoking article 10. The later attribute is achieved by placement of the ventilation zone 60 upstream of the flow restricting segment 44. Furthermore, placing the ventilation in zone 60 in spaced apart relation to the mouthpiece or downstream plug 48 of filtering material assures mixing of air drawn into the filter 40 through the ventilating zone 60 with mainstream smoke drawn from the tobacco rod 20.

In accordance with an embodiment, the flow restricting segment 44 includes a flow restricting element 45 (or orifice or flow regulator) comprised of a high-density capillary (cellulose acetate) tube having a 1 mm inner diameter and an 8 mm outer diameter, which has shown to provide about 47 or about 87 mm $H_2O$ pressure drop at a length of 5 mm or 10 mm, respectively.

Figure 5:
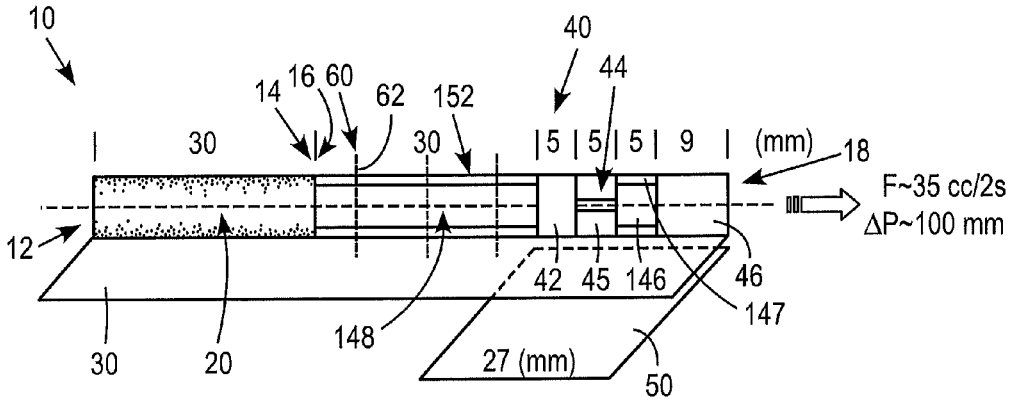
FIG. 5 is a side view of a smoking article in accordance with an embodiment.

FIG. 5 is a side view of a smoking article 10 in accordance with an embodiment. As shown in FIG. 5, the smoking article 10 includes a densely packed tobacco rod 20, an upstream cavity 148 formed with a hollow tubular segment 152, an upstream segment of filtering material 42, flow restricting segment 44 in the form of a flow restricting element 45 (or orifice or flow regulator), a downstream cavity 146 adjacent to the flow restricting segment 44, and a downstream segment of filtering material 46. In accordance with an embodiment, the downstream cavity 146 is defined at least in part by a tubular filter segment 147.

In accordance with an embodiment, the smoking article 10 has an overall length of about 84 mm comprising of a tobacco rod 20 of about 30 mm in length, a hollow tubular segment 152 of about 30 mm in length, an upstream segment of filtering material 42 of about 5 mm in length, a flow restricting element 45 of about 5 mm in length, a cavity 146 adjacent to the flow restricting element 45 of about 5 mm in length, and a downstream segment of filtering material 46 of about 9 mm in length. The smoking article 10 is preferably wrapped in a highly permeable wrapping material or paper 30, which extends from the lit end 12 of the tobacco rod 20 to the mouth or buccal end 18 of the filter 40. The wrapping material or paper 30 preferably has a length of about 84 mm. In addition, the tipping material or paper 50 on the mouth or buccal portion of the smoking article 10 preferably has a length of about 27 mm.

FIGS. 6 and 7 are charts showing the smoke chemistry for commercially available cigarettes and a series of smoking articles as shown in FIG. 5.

Figure 8A:
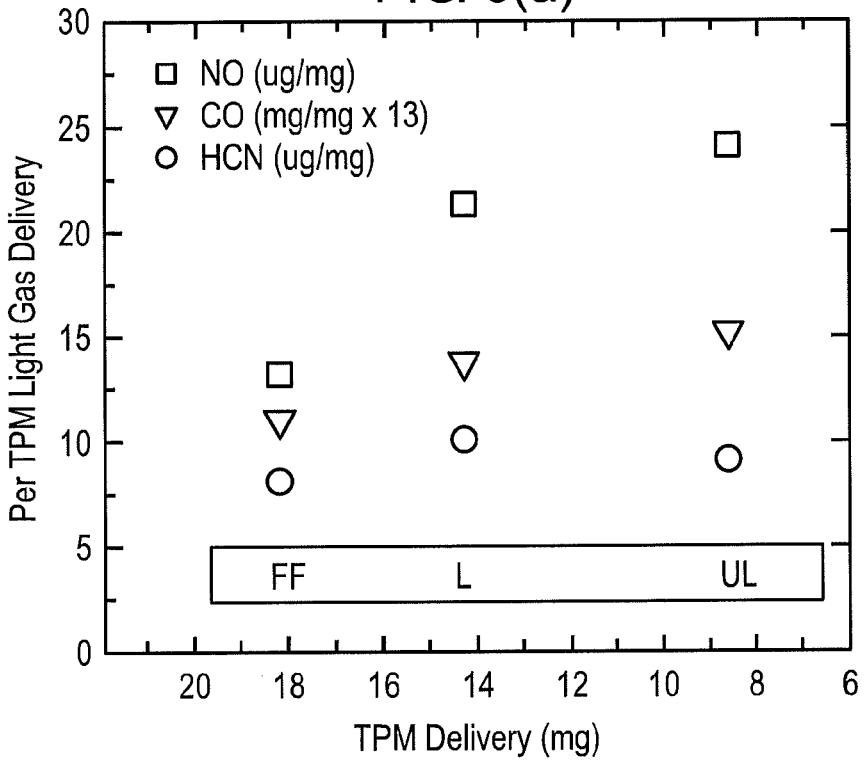
FIGS. 8(*a*) and 8(*b*) are graphs showing Per TPM (Total Particulate Matter) Light Gas Delivery versus TPM Delivery for commercially available cigarettes and a smoking article as shown in FIG. 5, respectively.
Figure 8B:
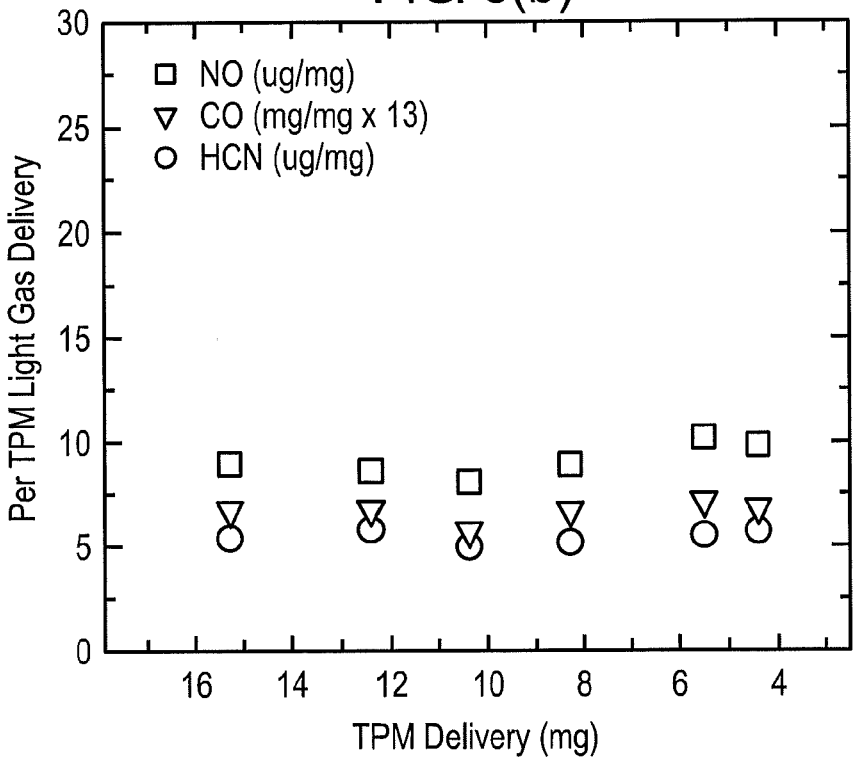

FIGS. 8(*a*) and 8(*b*) are graphs showing "Per TPM Light Gas Delivery" versus "TPM Delivery" for commercially available cigarettes and a smoking article as shown in FIG. 5, respectively.

Figure 9:
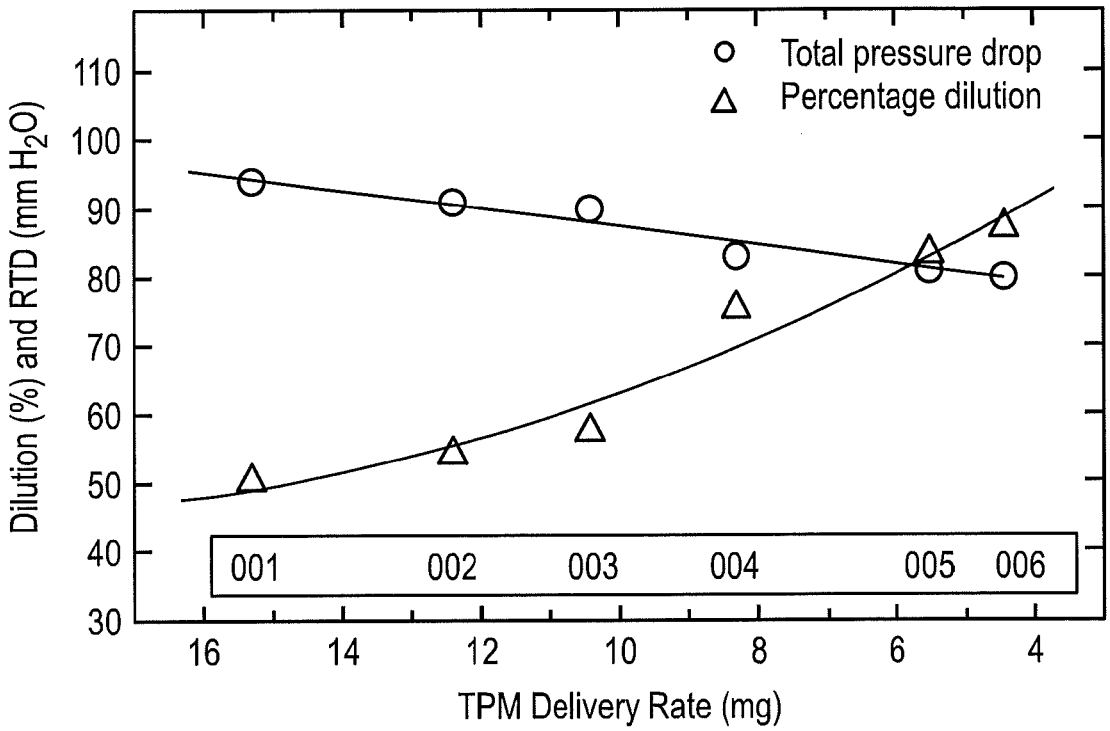
FIG. 9 is a graph showing Dilution (percentage—%) and RTD (mm $H_2O$) versus TPM Delivery Rate (mg) for a series of smoking articles as shown in FIG. 5.

FIG. 9 is a graph showing Dilution (%) and RTD (mm $H_2O$) versus TPM Delivery Rate (mg) for a series of smoking articles as shown in FIG. 5.

Figure 10A:
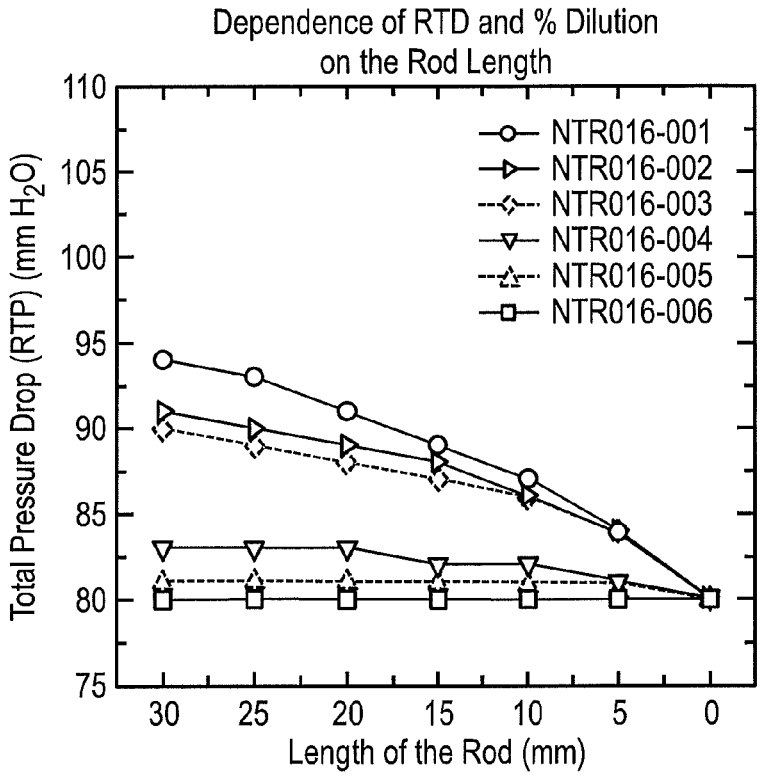
FIGS. 10(*a*) and 10(*b*) are graphs showing Total Pressure Drop and Percentage Dilution (%) versus Length of Rod for a series of smoking articles as shown in FIG. 5.
Figure 10B:
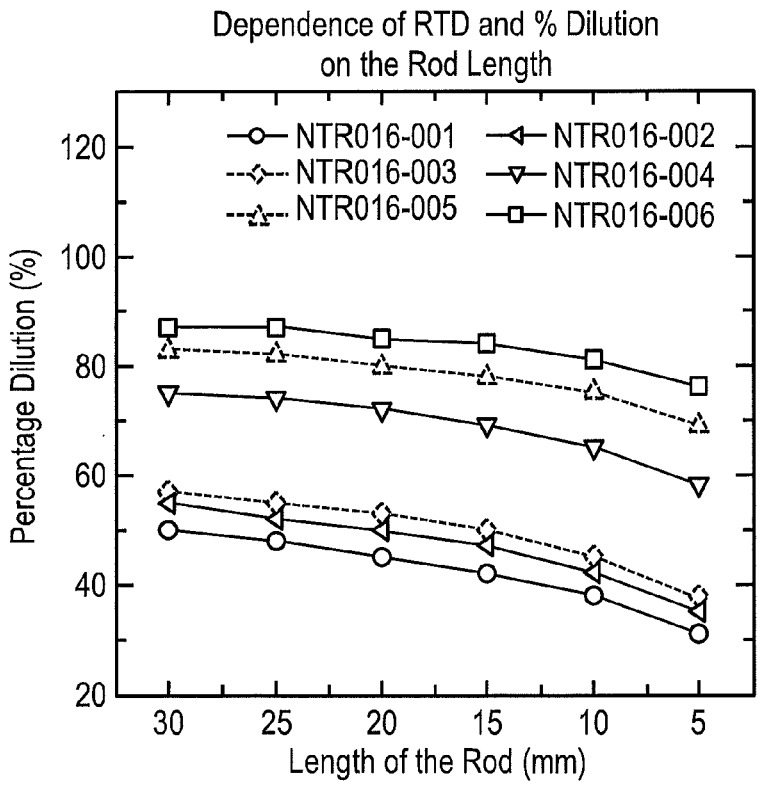

FIGS. 10(*a*) and 10(*b*) are graphs showing Total Pressure Drop and Percentage Dilution versus Length of Rod for a series of smoking articles as shown in FIG. 5.

Figure 11:
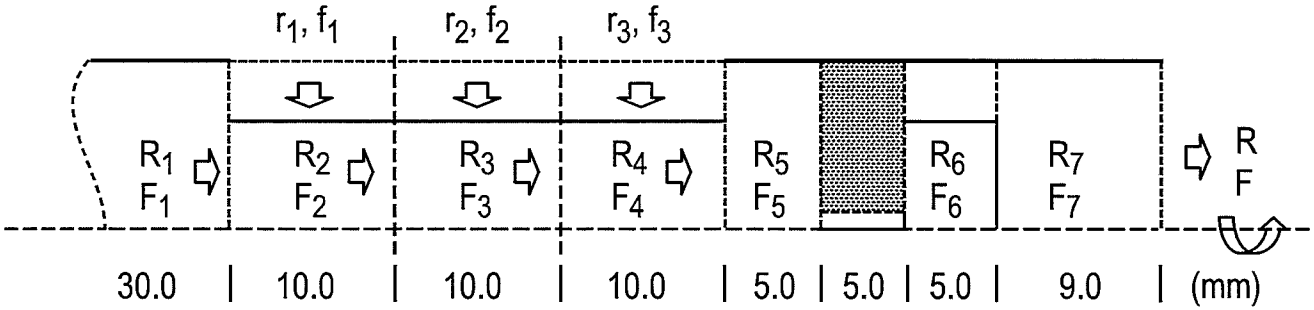
FIG. 11 is a side view of a smoking article in accordance with a further embodiment.
Figure 12:
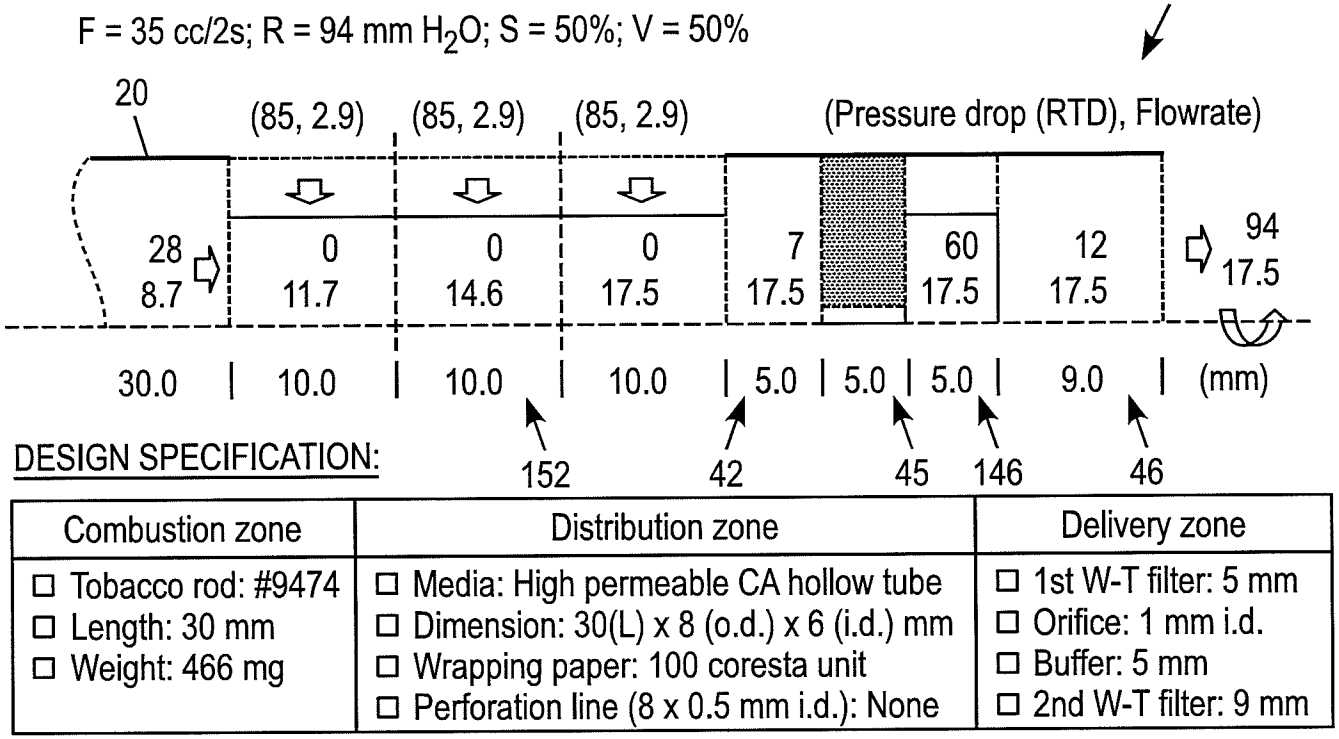
FIGS. 12-17 are side views of smoking articles showing the design specification on the combustion zone, distribution zone and delivery zone in accordance with various embodiments.
Figure 13:
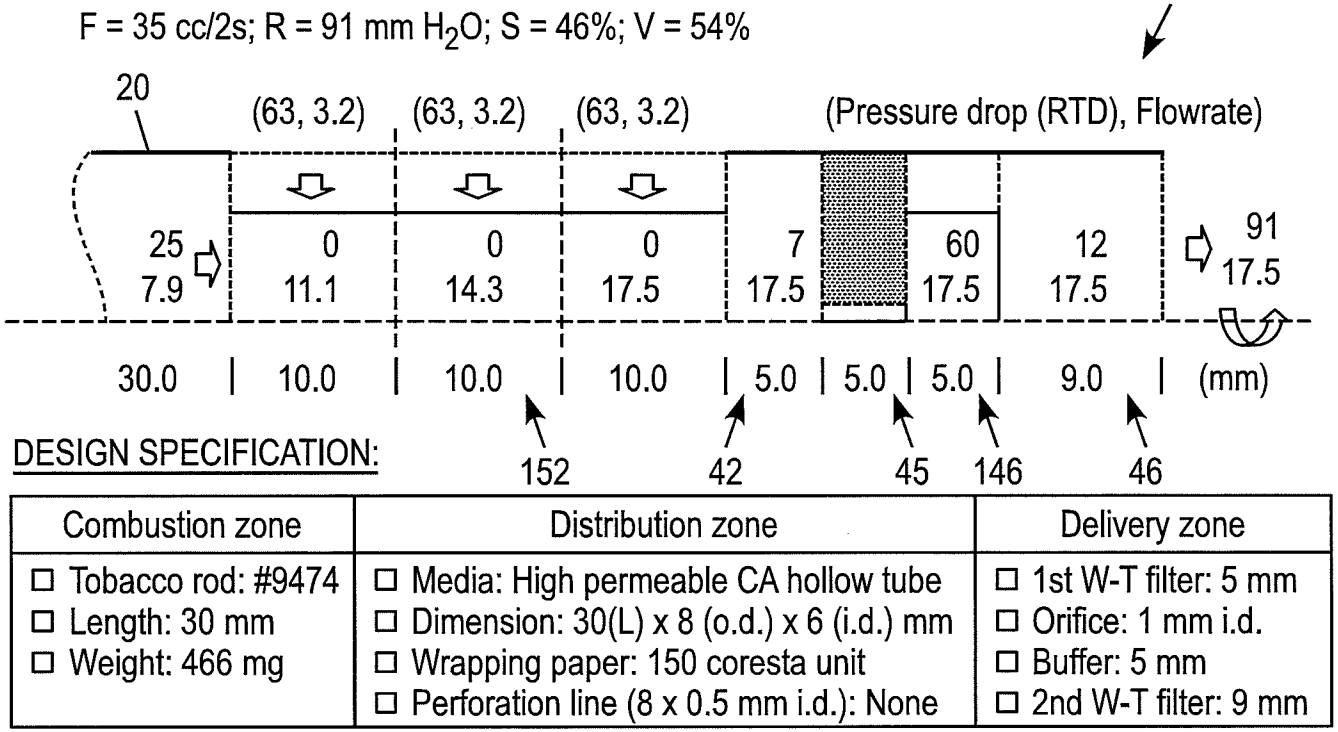
Figure 14:
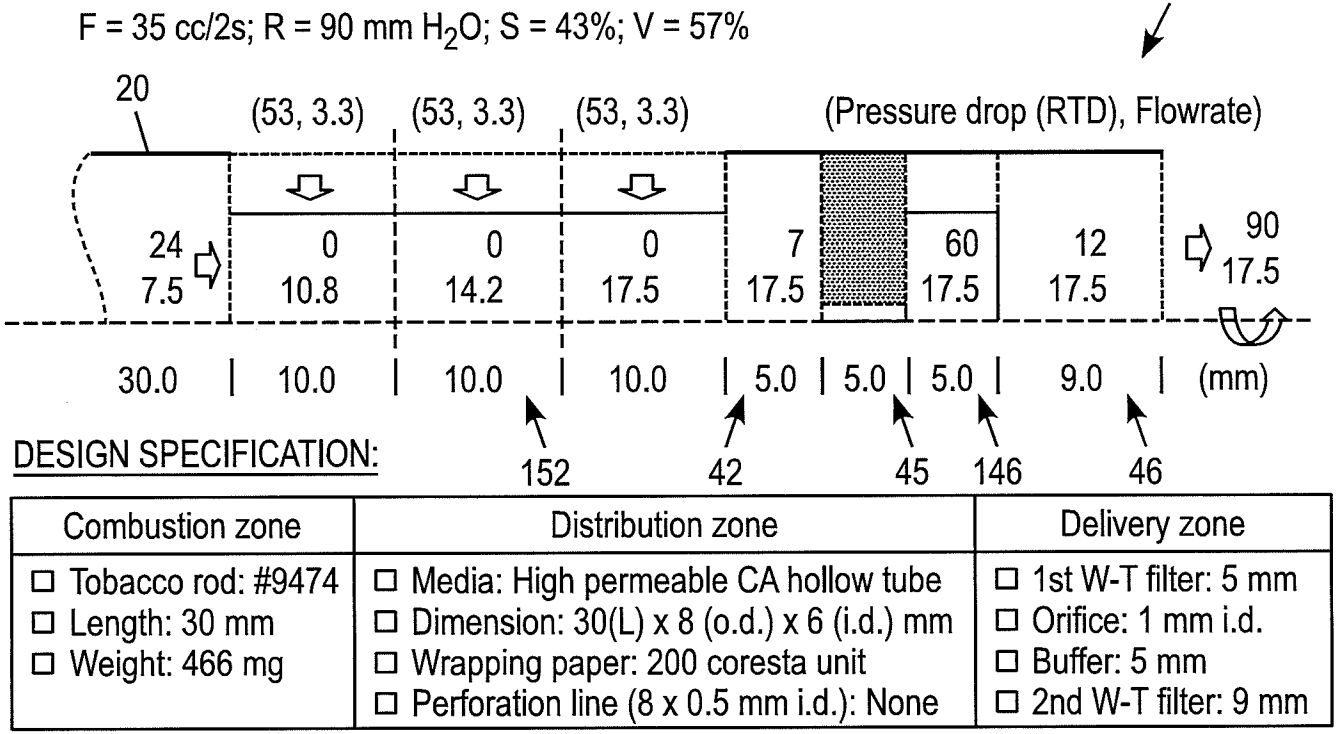
Figure 15:
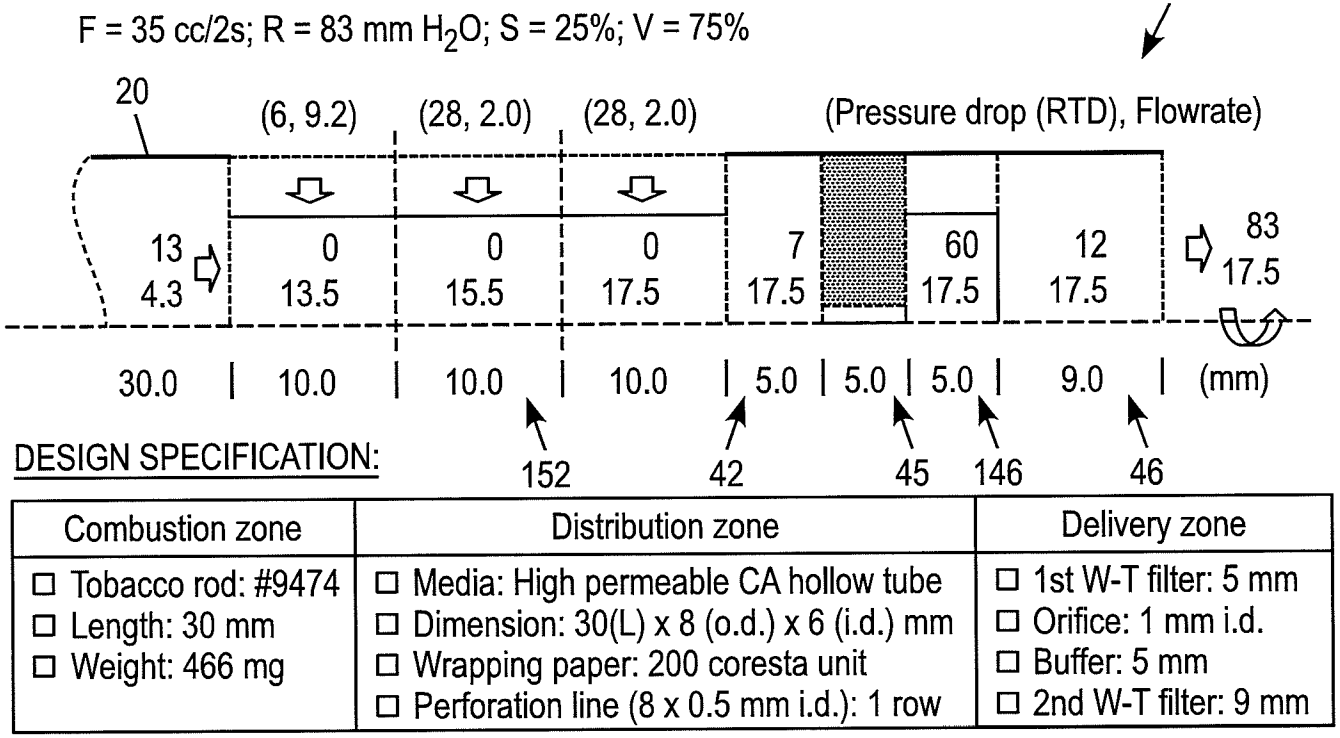
Figure 16:
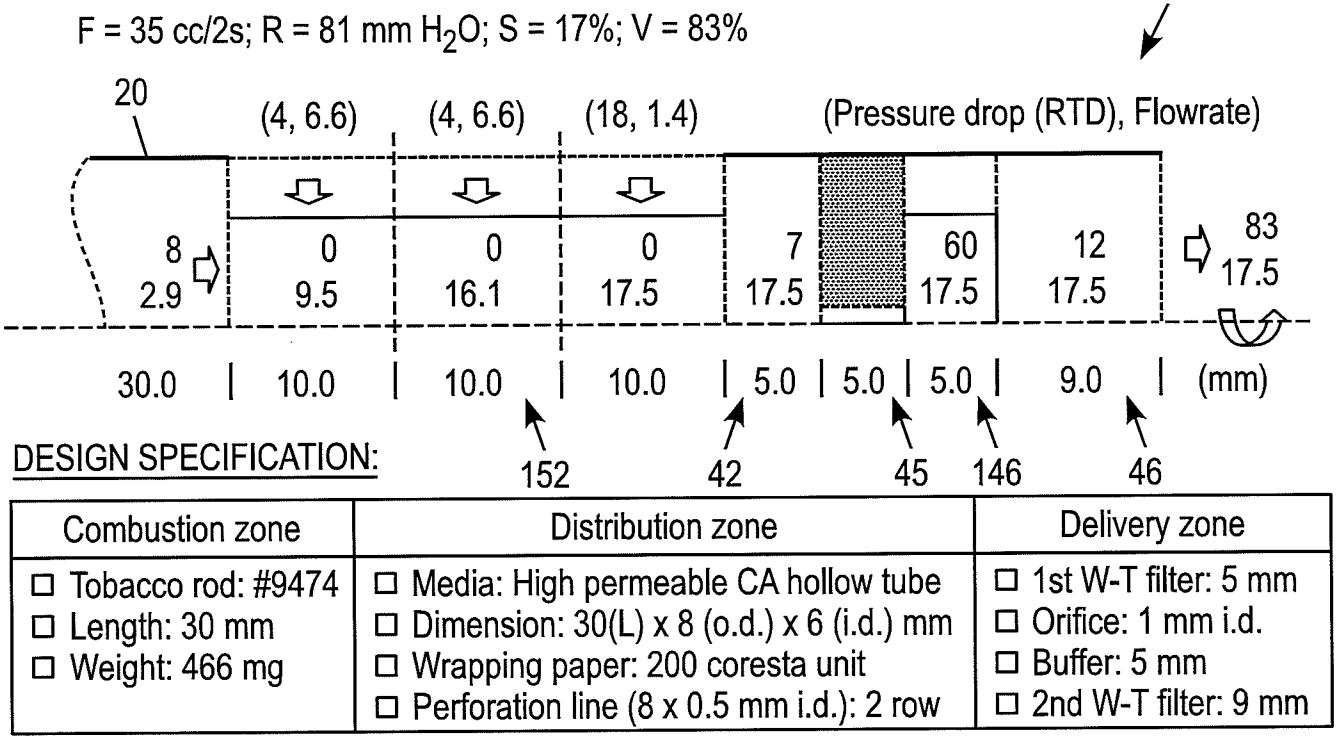
Figure 17:
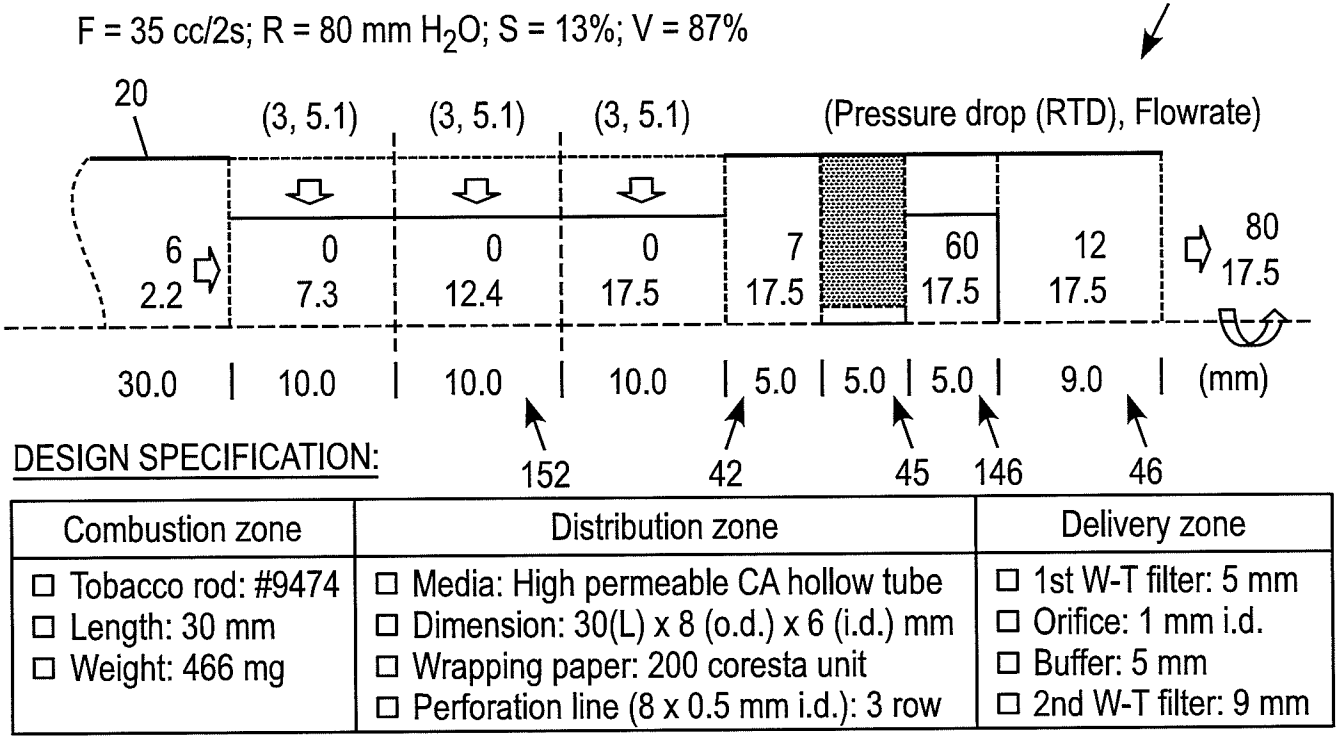
Figure 18:
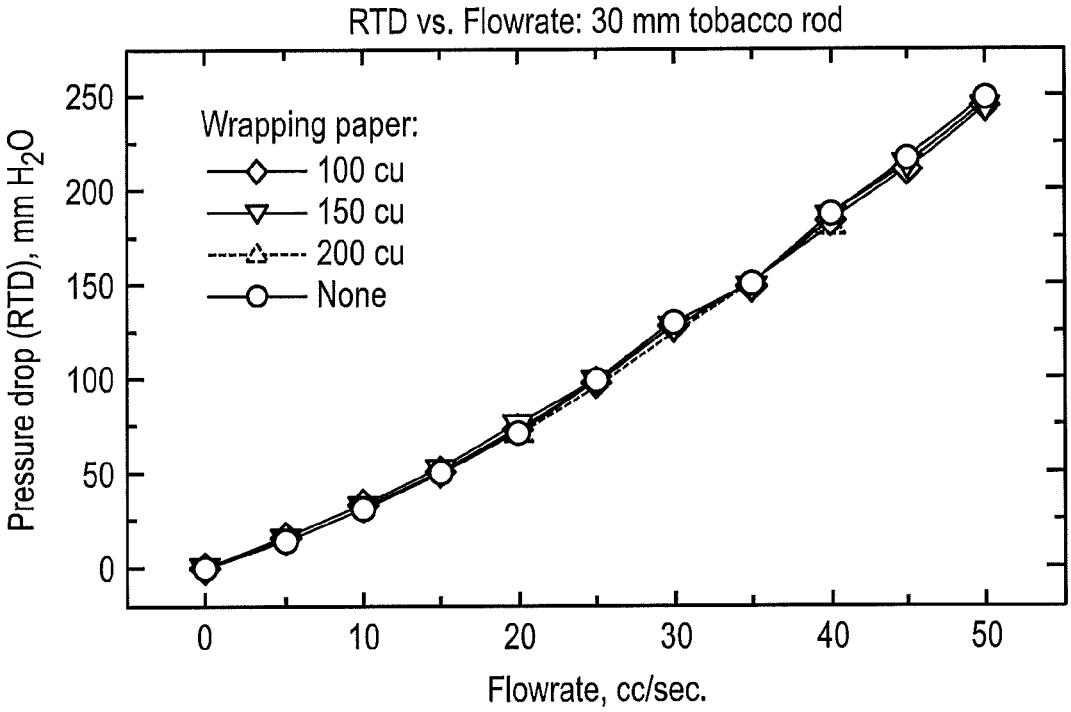
FIGS. 18-22 are graphs showing Pressure Drop versus Flow Rate for various embodiments, which include a 30 mm tobacco rod, a 10 mm Cellulose Acetate (CA) Tube without Dilution Holes, 10 mm Cellulose Acetate (CA) Tube with Dilution Holes, 5.0 mm PEEK Restrictor, and a Whistle-Through Filter.
Figure 19:
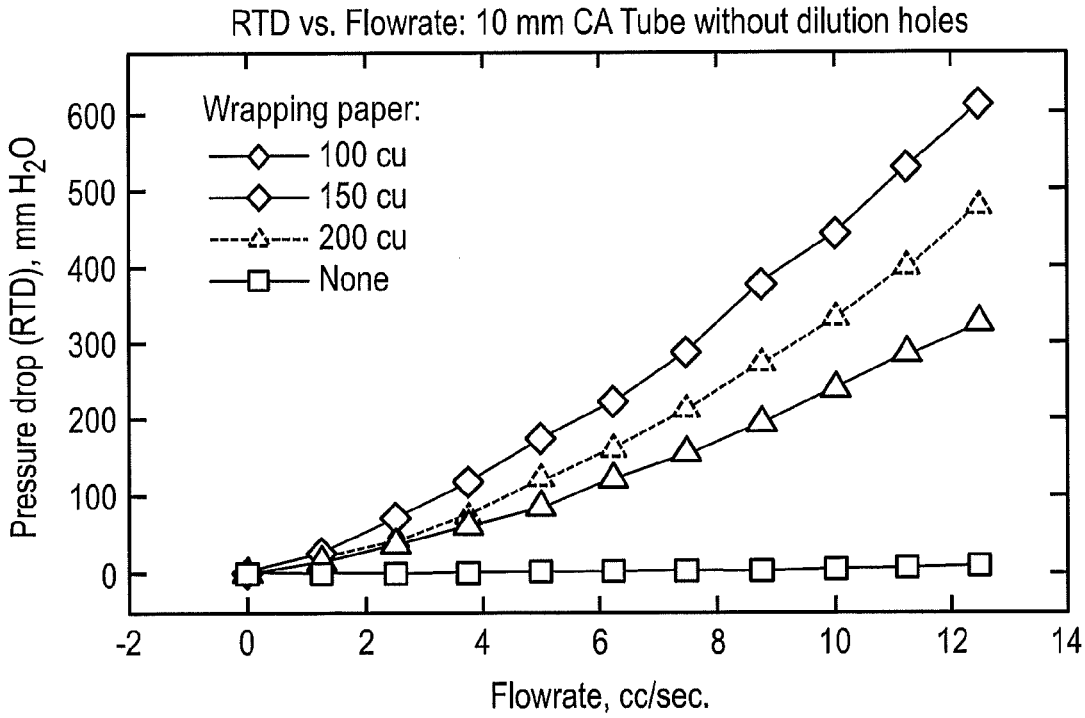
Figure 20:
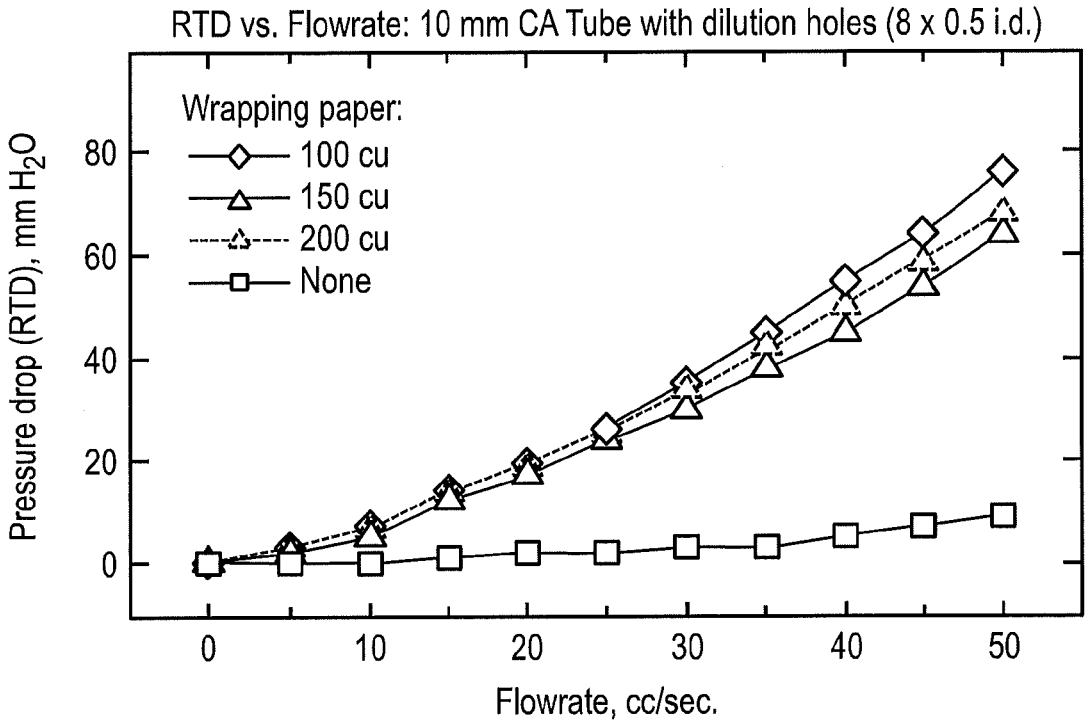
Figure 21:
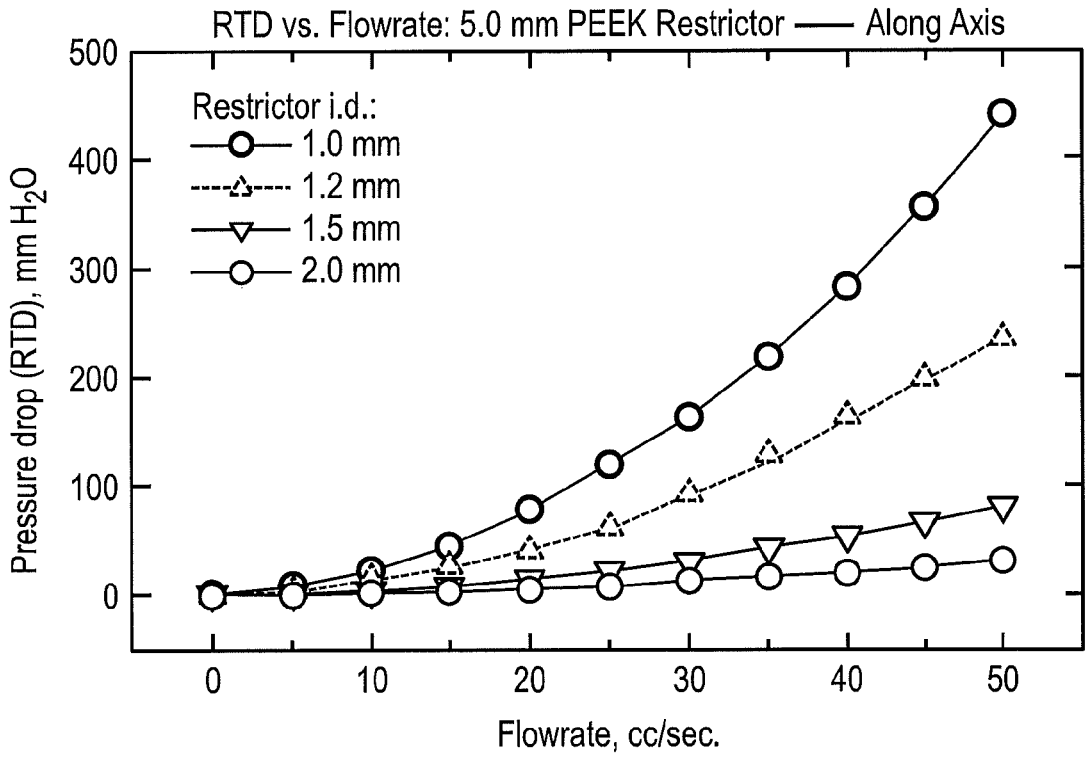

FIG. 11 is a side view of a smoking article 10 in accordance with an embodiment as shown in FIG. 5, and wherein the Pressure Drop (RTD) through each section ($R_i$, $r_i$), Flowrate through each section ($F_i$, $f_i$) and Total Flow (F) parameters for various sections are shown. In accordance with an embodiment, the correlations of constant and variables are as follows:

Total flowrate at the outlet of the mouth-end CA filter:

$F$=35 cc per 2 seconds(cc/2s)(FTC, 17.5 cc/s); 45 cc/2s; 55 cc/2s–

The Only Input

Flowrate:

$$F=F7=F6=F5=F4$$

$$F4=F3+f3$$

$$F3=F2+f2$$

$$F2=F1+f1$$

Therefore, the smoke delivery rate S and ventilation V:

$$S=F1/F;\ V=(f1+f2+f3)/F$$

Pressure drop to the inlet of the CA hollow tube:

$$R_1'=R_1$$

Pressure drop through and at the outlet of the CA hollow tube:

$$R_2'=R_2+R_1'\times r_1/(R_1'+r_1)$$

$$R_3'=R_3+R_2'\times r_2/(R_2'+r_2)$$

$$R_4'=R_4+R_3'\times r_3/(R_3'+r_3)$$

$$R=R_4'+R_5+R_6+R_7$$

Correlation of pressure drop and flowrate:

$(r_i,f_i);(R_i,F_i)$ $i$=1~7 of each section

Flow distribution:

$$F_7=F_6=F_5=F_4=F$$

$$F_3=F_4\times r_3/(R_3'+r_3)\ f_3=F_4\times R_3'/(R_3'+r_3)$$

$$F_2=F_3\times r_2/(R_2'+r_2)\ f_2=F_3\times R_2'/(R_2'+r_2)$$

$$F_1=F_2\times r_1/(R_1'+r_1)\ f_1=F_2\times R_1'/(R_1'+r)$$

FIGS. 12-17 are side views of smoking articles 10 showing the design specification on the tobacco rod 20 (i.e., combustion zone), hollow tubular segment 152 (i.e., distribution zone) and the upstream segment of filtering material 42, the flow restricting element 45, the cavity 146 adjacent to the flow restricting element 45, and the downstream segment of filtering material 46 (i.e., delivery zone) in accordance with various embodiments.

Figure 22:
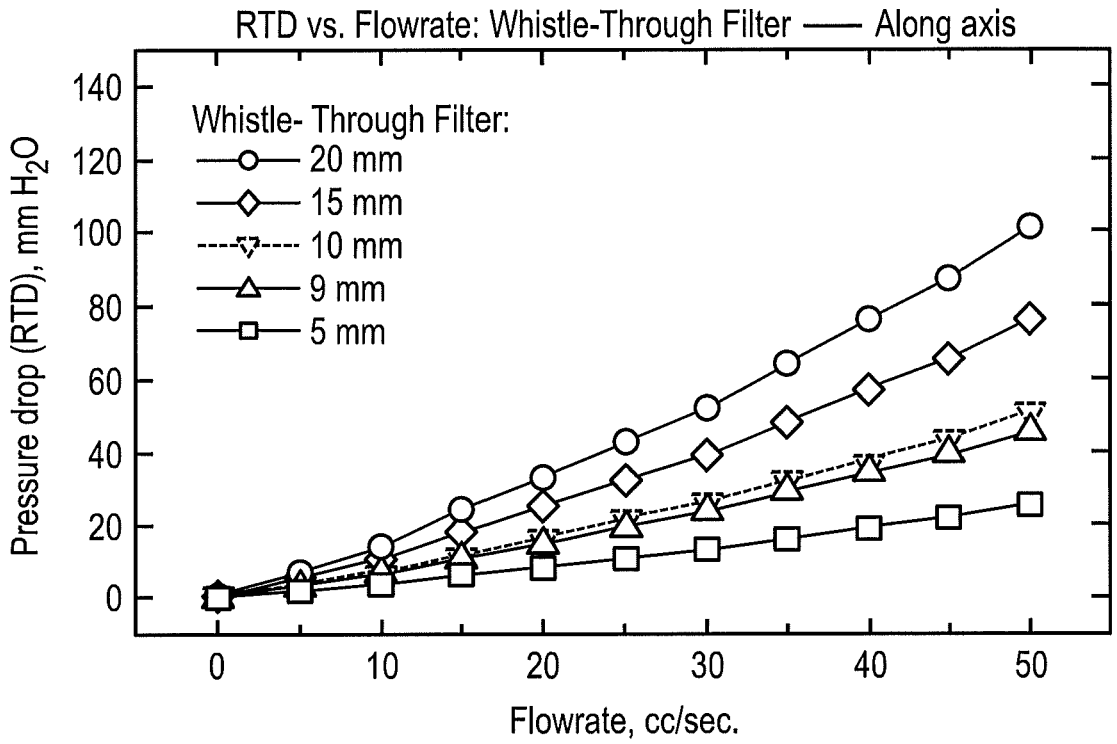

FIGS. 18-22 are graphs showing Pressure Drop versus Flow Rate for various embodiments, which include a 30 mm tobacco rod (Table 1 and FIG. 18), a 10 mm Cellulose Acetate (CA) Tube without Dilution Holes (Table 2 and FIG. 19), 10 mm Cellulose Acetate (CA) Tube with Dilution Holes (Table 3 and FIG. 20), 5.0 mm PEEK Restrictor (Table 4 and FIG. 21), and a Whistle-Through Filter (Table 5 and FIG. 22).

TABLE 1

Resistance to Draw (RTD) vs. Flowrate for a 30 mm tobacco rod:

| Flowrate (cc/s) | | 0 | 5 | 10 | 15 | 20 | 25 | 30 | 35 | 40 | 45 | 50 |
|---|---|---|---|---|---|---|---|---|---|---|---|---|
| RTD (mm | 100 | 0 | 16 | 33 | 50 | 73 | 97 | 128 | 148 | 184 | 210 | 243 |
| H2O) vs. | 150 | 0 | 16 | 33 | 52 | 76 | 99 | 128 | 149 | 186 | 214 | 243 |
| Wrapping | 200 | 0 | 14 | 30 | 49 | 70 | 94 | 122 | 149 | 180 | 210 | 246 |
| paper | (No) | 0 | 14 | 31 | 50 | 71 | 99 | 130 | 150 | 187 | 216 | 248 |
| (Coresta unit) | | | | | | | | | | | | |

Data fitting:

(1) ΔP = a + bF + cF2, where a, b and c are constants.

(2) It seems that RTD is independent of wrapping paper

Fitting parameters:

ΔP = −0.76224 + 2.99557F + 0.03809F2

TABLE 2

Resistance to Draw (RTD) vs. Flowrate for a 10 mm Cellulose Acetate (CA) Tube without dilution holes:

| Flowrate × 4 (cc/s) | | 0 | 5 | 10 | 15 | 20 | 25 | 30 | 35 | 40 | 45 | 50 |
|---|---|---|---|---|---|---|---|---|---|---|---|---|
| RTD (mm | 100 | 0 | 26 | 71 | 118 | 174 | 222 | 289 | 377 | 444 | 529 | 611 |
| H2O) vs. | 150 | 0 | 21 | 42 | 76 | 120 | 162 | 212 | 274 | 333 | 398 | 427 |
| Wrapping | 200 | 0 | 14 | 36 | 61 | 85 | 123 | 154 | 194 | 240 | 286 | 325 |
| paper | (No) | 0 | 0 | 0 | 1 | 2 | 2 | 3 | 3 | 5 | 7 | 9 |
| (Coresta unit) | | | | | | | | | | | | |

Data fitting:

ΔP = a + bF + cF2, where a, b and c are constants.

Coresta unit: Fitting parameters:

100 ΔP = −4.00699 + 25.13585F + 1.95655F2

150 ΔP = −1.33566 + 14.09902F + 1.92895F2

200 ΔP = −2.34965 + 12.74406F + 1.10993F2

CA tube only ΔP = 0.05594 − 0.138930F + 0.06639F2

TABLE 3

| Resistance to Draw (RTD) vs. Flowrate for a 10 mm Cellulose Acetate (CA) Tube with dilution holes: | | | | | | | | | | | | |
|---|---|---|---|---|---|---|---|---|---|---|---|---|
| Flowrate × 4 (cc/s) | | 0 | 5 | 10 | 15 | 20 | 25 | 30 | 35 | 40 | 45 | 50 |
| RTD (mm H2O) vs. Wrapping paper (Coresta unit) | 100 | 0 | 3 | 7 | 14 | 19 | 26 | 35 | 45 | 55 | 64 | 76 |
| | 150 | 0 | 3 | 7 | 14 | 19 | 26 | 33 | 41 | 50 | 59 | 69 |
| | 200 | 0 | 2 | 5 | 12 | 17 | 24 | 30 | 38 | 45 | 54 | 64 |
| | (No) | 0 | 0 | 0 | 1 | 2 | 2 | 3 | 3 | 5 | 7 | 9 |

Data fitting:
$\Delta P = a + bF + cF2$, where a, b and c are constants.
Coresta unit: Fitting parameters:
100 $\Delta P = -0.53846 + 0.65240F + 0.01772F2$
150 $\Delta P = -0.53147 + 0.71207F + 0.01361F2$
200 $\Delta P = -1.00699 + 0.63669F + 0.01319F2$
CA tube only $\Delta P = 0.05594 - 0.138930F + 0.06639F2$

TABLE 4

| Resistance to Draw (RTD) vs. Flowrate for 5.0 mm PEEK Restrictor - Along Axis: | | | | | | | | | | | | |
|---|---|---|---|---|---|---|---|---|---|---|---|---|
| Flowrate (cc/s) | | 0 | 5 | 10 | 15 | 20 | 25 | 30 | 35 | 40 | 45 | 50 |
| RTD (mm H2O) vs. Restrictor i.d. (mm) | 1.0 | 0 | 7 | 22 | 45 | 78 | 120 | 163 | 219 | 282 | 354 | 440 |
| | 1.2 | 0 | 3 | 12 | 24 | 42 | 62 | 90 | 120 | 156 | 196 | 234 |
| | 1.5 | 0 | 1 | 3 | 7 | 14 | 21 | 30 | 43 | 54 | 66 | 80 |
| | 2.0 | 0 | 0 | 2 | 3 | 5 | 7 | 12 | 16 | 19 | 24 | 31 |

Data fitting:
$\Delta P = a + bF + cF2$, where a, b and c are constants.
Restrictor i.d. (mm): Fitting parameters:
1.0 $\Delta P = 0.39161 + 0.54960F + 0.16359F2$
1.2 $\Delta P = -0.86713 + 0.40774F + 0.08690F2$
1.5 $\Delta P = -0.78322 + 0.14867F + 0.02979F2$
2.0 $\Delta P = -0.02098 + 0.02401F + 0.01170F2$

TABLE 5

| Resistance to Draw (RTD) vs. Flowrate for Whistle-Through Filter - Along Axis | | | | | | | | | | | | |
|---|---|---|---|---|---|---|---|---|---|---|---|---|
| Flowrate × 4 (cc/s) | | 0 | 5 | 10 | 15 | 20 | 25 | 30 | 35 | 40 | 45 | 50 |
| RTD (mm H2O) Vs. Varying length | 5 mm | 0 | 2 | 4 | 6 | 8 | 11 | 13 | 16 | 19 | 22 | 25 |
| | 9 mm | 0 | 3 | 6 | 11 | 15 | 19 | 23 | 29 | 34 | 39 | 45 |
| | 10 mm | 0 | 4 | 7 | 12 | 17 | 22 | 26 | 32 | 38 | 44 | 51 |
| | 15 mm | 0 | 5 | 10 | 18 | 25 | 32 | 39 | 48 | 57 | 65 | 76 |
| | 20 mm | 0 | 7 | 14 | 24 | 33 | 43 | 52 | 64 | 76 | 87 | 101 |

Data fitting:
$\Delta P = a + bF + cF2$, where a, b and c are constants.
Length of CA tube: Fitting parameters:
5 mm $\Delta P = -0.06469 + 0.34953F + 0.00310F2$
9 mm $\Delta P = -0.11643 + 0.62916F + 0.00558F2$
10 mm $\Delta P = -0.12937 + 0.69907F + 0.00620F2$
15 mm $\Delta P = -0.19406 + 1.04861F + 0.0093F2$
20 mm $\Delta P = -0.25874 + 1.39814F + 0.01240F2$ It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a tobacco rod, which is adapted to produce mainstream smoke;

a filter attached to said tobacco rod, the filter having an upstream end portion and a downstream end portion, the filter comprising:

a flow restricting segment of smoke impermeable material, which includes at least one open flow passage therethrough to deliver mainstream smoke; and a cavity downstream of the flow restricting segment;

at least one ventilation zone upstream of the filter, and wherein the at least one ventilation zone is about 30 mm long;

a permeable wrapping paper, which circumscribes the tobacco rod, the at least one ventilation zone and the filter; and wherein the tobacco rod has a density of at least 10 to 200% greater than a standard tobacco rod having a packing density of about 300 mg/cm$^3$ and wherein the tobacco rod is about 25 mm to about 35 mm long before being lit.

2. The smoking article of claim 1, wherein the permeable wrapping paper has a permeability of at least 100 Coresta units.

3. The smoking article of claim 1, wherein the at least one ventilation zone comprises at least one row of perforations or holes, which extend through the wrapping paper.

4. The smoking article of claim 1, further comprising a paper on the downstream end portion of the filter and wherein the at least one ventilation zone comprises at least one row of perforations or holes, which extend through the paper and the wrapping paper.

5. The smoking article of claim 1, further comprising a downstream segment of filtering material on the downstream end portion of the filter.

6. The smoking article of claim 5, further comprising an upstream cavity, the upstream cavity provided between the upstream end portion and the flow restricting segment, and wherein the downstream cavity is provided between the flow restricting segment and the downstream segment of filtering material.

7. The smoking article of claim 5, wherein the downstream segment of filtering material is a cellulose acetate material.

8. The smoking article of claim 1, further comprising an upstream segment of filtering material.

9. The smoking article of claim 8, wherein the upstream plug of filtering material is a cellulose acetate material with activated carbon throughout.

10. The smoking article of claim 1, wherein the at least one open flow passage of the flow restriction segment has a diameter of about 0.2 mm to about 2.0 mm.

11. The smoking article of claim 1, wherein the filter further includes a highly permeable cellulose acetate hollow tube on an upstream end of the flow restriction segment.

12. The smoking article of claim 1, wherein the flow restricting segment includes a whistle-through cellulose acetate filter, which is placed adjacent to the flow restricting segment.

13. The smoking article of claim 1, wherein the flow restricting element is a polymer column with a centered bypass passage having a diameter of 0.5 to 2.0 mm.

14. The smoking article of claim 1, wherein the flow restriction element is a cellulose acetate column with a central bypass passage having a diameter of 0.5 to 2.0 mm.

15. A smoking article comprising:

a tobacco rod having a density of at least 10 to 200% greater than a standard tobacco rod having a packing density of about 300 mg/cm$^3$ and wherein the tobacco rod is about 25 mm to about 35 mm long before being lit, the tobacco rod adapted to produce mainstream smoke; and a filter having an upstream end portion and a downstream end portion, said filter arranged to receive mainstream smoke at said upstream end portion, said filter comprising:

a diffusion zone, which allows significant air inflow to dilute and transfer the smoke directly to the downstream portion of filter, the diffusion zone having a highly permeable cellulose acetate hollow tube and a high permeable wrapping paper, and wherein the diffusion zone is about 30 mm long; and a delivery zone downstream of the diffusion zone, the delivery zone comprising a flow restriction element with a downstream cavity as a flow buffer for desirable draw resistance, wherein the flow restriction element includes a restriction establishing a substantial portion of a predetermined resistance to draw of said smoking article, and wherein the delivery zone is about 24 mm long.

16. The smoking article of claim 15, further comprising a whistle-through cellulose acetate filter, which is placed adjacent to the flow restriction element.

17. The smoking article of claim 15, wherein the flow restriction element is a polymer column with a centered bypass hole having a diameter of 0.5 to 2.0 mm.

18. The smoking article of claim 15, wherein the flow restriction element is a cellulose acetate column with a central bypass hole having a diameter of 0.5 to 2.0 mm.

19. The smoking article of claim 15, further comprising a mouthpiece filter plug segment of cellulose acetate tow of about 5.0 denier to about 15.0 denier per filament at the downstream end portion of the filter.

20. The smoking article of claim 15, wherein the diffusion zone includes at least one row of perforations or holes, which extend through the paper and the wrapping paper.

* * * * *